US011371248B2

(12) United States Patent
Confetti

(10) Patent No.: US 11,371,248 B2
(45) Date of Patent: Jun. 28, 2022

(54) SELF-DRAINING PORCELAIN STONEWARE TILE

(71) Applicants: Cristian Confetti, Montevideo (UY); PILEGAR S.A., Montevideo (UY)

(72) Inventor: Cristian Confetti, Montevideo (UY)

(73) Assignee: PILEGAR S.A., Montevideo (UY)

( * ) Notice: Subject to any disclaimer, the term of this patent is extended or adjusted under 35 U.S.C. 154(b) by 0 days.

(21) Appl. No.: 16/976,904

(22) PCT Filed: Mar. 4, 2019

(86) PCT No.: PCT/EP2019/055335
§ 371 (c)(1),
(2) Date: Aug. 31, 2020

(87) PCT Pub. No.: WO2019/170612
PCT Pub. Date: Sep. 12, 2019

(65) Prior Publication Data

US 2021/0040746 A1 Feb. 11, 2021

(30) Foreign Application Priority Data

Mar. 5, 2018 (IT) ..... 102018000003283

(51) Int. Cl.
*E04F 15/02* (2006.01)
*E04F 15/08* (2006.01)
(Continued)

(52) U.S. Cl.
CPC .... *E04F 15/02161* (2013.01); *B28B 11/0863* (2013.01); *B28B 11/10* (2013.01); *E04F 15/08* (2013.01)

(58) Field of Classification Search
CPC ..... E04F 15/02161; E04F 15/02177; E04F 15/02188; E04F 15/08
See application file for complete search history.

(56) References Cited

U.S. PATENT DOCUMENTS 4,907,387 A * 3/1990 Turnbull ..... E04F 15/02183 52/177
5,475,952 A * 12/1995 O'Connor ..... B32B 3/26 428/163
(Continued)

FOREIGN PATENT DOCUMENTS

FR 1181762 A * 6/1959 ..... A01K 1/015
GB 628223 A * 8/1949 ..... E04F 15/02161
(Continued)

OTHER PUBLICATIONS

Notification Concerning Transmittal of International Preliminary Report on Patentability (Chapter 1 of the Patent Cooperation Treaty) dated Sep. 17, 2020 (Sep. 17, 2020) issued on related international patent application PCT/EP2019/055335 by The International Bureau of WIPO.

*Primary Examiner* — Christine T Cajilig
(74) *Attorney, Agent, or Firm* — Dickinson Wright PLLC

(57) ABSTRACT

The invention concerns the production of draining porcelain stoneware tiles and method of production thereof. The invention concerns a tile with rectangular quadrilateral shape and edges with thickness (S), with a planar outer surface on which a series of variable geometry grooves are provided according to a drainage direction on the outer surface. The geometry of said groove can be triangular, trapezoidal or elliptical section. The vertexes of these embodiments form the bottom of said groove with height h, and said height h increases according to said drainage direction generating an inclined drainage plane of said groove. The invention also concerns a method of manufacturing a tile according to the invention; by moulding during the pressing phase of the ceramic powders with the use of punch/pad preformed with pattern according to the required geometry of the water drain grooves; by mechanical action
(Continued)

by incision of the green pressed ceramic powder slab, dried or not, and not yet fired; or by incision of the fired tile.

14 Claims, 7 Drawing Sheets

(51) Int. Cl.
*B28B 11/08* (2006.01)
*B28B 11/10* (2006.01)

(56) References Cited

U.S. PATENT DOCUMENTS 6,058,659 A * 5/2000 Astrom ..... E04F 15/02 4/251.1
6,539,643 B1 * 4/2003 Gleeson ..... E04C 2/043 33/563
2002/0088191 A1 7/2002 Vos
2004/0086693 A1 * 5/2004 Saldarelli ..... E04F 15/02161 428/172
2005/0066955 A1 * 3/2005 Pedrini ..... B28D 1/048 125/12
2005/0129913 A1 * 6/2005 Kobayashi ..... E04F 15/02 428/167
2008/0190048 A1 * 8/2008 Kitakado ..... E04F 15/02 52/177
2012/0317913 A1 12/2012 Esquivel
2015/0068145 A1 * 3/2015 Sjoden ..... E04D 13/1693 52/302.1

FOREIGN PATENT DOCUMENTS

KR 200462410 Y1 * 9/2012
WO WO-9100402 A1 * 1/1991 ..... B32B 9/04
WO WO-02062568 A2 * 8/2002 ..... F28D 5/00
WO 2018076043 5/2018

* cited by examiner

SELF-DRAINING PORCELAIN STONEWARE TILE

CROSS REFERENCE TO RELATED APPLICATIONS

This application is a U.S. National Phase patent application of and claims priority to PCT/EP2019/055335, filed Mar. 4, 2019, which claims priority to and the benefit of Italian Patent Application 102018000003283, filed on Mar. 5, 2018, each of the foregoing applications being incorporated herein by reference for all purposes.

FIELD AND BACKGROUND OF THE INVENTION

Field of the Invention

The present invention concerns a self-draining porcelain stoneware tile. In particular, the invention concerns a self-draining porcelain stoneware tile in which, on the planar outer surface of the tile, a series of variable geometry grooves are provided according to a drainage direction.

Background of the Invention

Porcelain stoneware has always been considered a suitable product for extreme uses due to certain technical characteristics that make it superior in performance to any other product of ceramic and non-ceramic origin.

The very low and/or null absorption of water, resistance to both acid and alkaline chemical agents, frost-resistance, high mechanical resistance to both loads and surface wear are some of the characteristics that distinguish the superiority of this noble product.

In recent years, high technical performance has been accompanied by improved aesthetic standards due to the evolution of manufacturing technologies.

Today, the similarity with natural products is total; it is increasingly difficult to distinguish real marble, real stone and real wood from the version reproduced in porcelain stoneware.

These aspects have widened the range of use of porcelain stoneware, making it an ideal solution for numerous architectural contexts, including residential/private use, commercial/public use and use in urban and/or industrial environments where compliance with safety regulations is a prerequisite for sale and specification (prescription) of the product.

In this context the use of porcelain stoneware products, both technical and glazed, is becoming increasingly common in both dry and wet outdoor environments, indoor environments subject to wetting or high humidity levels, and industrial environments where the use of cleaning agents is combined with washing using large quantities of water.

In these conditions it is important to maintain all the characteristics previously described and combine them with a high resistance to slipping.

The products currently on the market, including those specifically developed to comply with the current laws, are characterized by surfaces in which the "non-slip" characteristic is the consequence or result of a rough surface obtained in the moulding/pressing phase (with special punches/moulds/devices that give the surface of the piece non-slip characteristics) or with the addition of non-slip products like aggregates (corundum, aluminates, sand, ceramic grit etc.) during glazing in the phase prior to firing.

Nevertheless, to obtain a non-slip effect also with a very high presence of water, it is necessary to discharge the excess liquid to avoid flooding of the surface. The excess water, not discharged, creates a film that acts as an insulator between the shoe/foot, which floats, and the non-slip agent with consequent loss of adhesion similar to the aquaplaning effect.

SUMMARY OF THE INVENTION

The object of the present invention is to remedy the drawbacks described and this is achieved with a draining porcelain stoneware tile comprising a tile having quadrangular dimensions and edges with thickness (S), a planar outer surface of said tile, and a series of variable geometry grooves according to a draining direction provided on the outer surface according to claims 1-3.

According to a first embodiment, the geometry of the groove has a triangular section. The triangular section has a base and a vertex located at a height h from the base and oblique sides connecting base and vertex which form angles (a) and (P) with respect to the base. The base is located on said planar surface, the vertex forms the bottom of said groove. The height h increases according to said drainage direction generating an inclined drainage plane in said groove.

According to a second embodiment, the geometry of the groove has a trapezoidal section, in which the major base is located on the planar surface, the minor base forms the bottom of said groove, the oblique sides connecting said major and minor bases with angles (a) and (P) relative to said major base and a height h between the above-mentioned bases. The height h increases according to the drainage direction generating an inclined drainage plane in said groove.

According to a third embodiment, the geometry of said groove has a semi-elliptical section limited to a semi-axis, preferably the minor semi-axis. The semi-axis of the semi-elliptical section is located on said planar surface, an opposite vertex that forms the bottom of said groove is located at a height h between said semi-axis. The height h increases according to the drainage direction generating an inclined drainage plane in said groove.

According to different preferential embodiments, the drainage direction runs from the central axis of said planar surface towards the opposite edges of said tile, in which the grooves develop by parallel lines perpendicular to the respective edges; or the drainage direction is from the diagonal axes of said planar surface towards the opposite edges of said tile, in which the grooves develop by parallel lines perpendicular to the respective edges.

According to a further preferential embodiment the tile has a drain fulcrum located on said planar surface and said drainage direction develops radially from the edges of said tile towards said drain fulcrum.

The development of the trapezoidal sections according to the drainage direction can generate a trapezoidal groove with said minor surface with an inclination according to said drainage direction having a gradient ranging from 0.3% to 5.0%; preferably from 0.5% to 3.0%; more preferably from 1.0% % to 3.0%.

The trapezoidal section can be preferably isosceles and the ratio between the dimensions of said minor and major bases can range from 1:3 to 1:6; preferably said isosceles angle can range from 70° to 15°, and said ratio between the dimensions of said minor and major bases can range from 1:4 to 1:5.

The invention also concerns a method for manufacturing a tile according to the invention. The method can comprise a moulding phase during the pressing phase of the ceramic powders which form said ceramic piece with the use of punch/pad preformed with the pattern according to the required geometry of the water drainage grooves.

Alternatively, the method can entail formation of the grooves by incision of the green tile in which the pressed ceramic powder slab, dried or not, and not yet fired, is subjected to mechanical incision of the planar outer surface of said slab by means of diamond wheels, to create incisions according to the required geometry.

Alternatively, the method can entail formation of the grooves by incision of the fired tile in which the slab is subjected to mechanical incision of the planar outer surface thereof with diamond wheels, to create incisions according to the required geometry.

BRIEF DESCRIPTION OF THE DRAWINGS

To better understand the characteristics and advantages, a preferred embodiment is described below, solely by way of non-limiting example, with reference to the accompanying drawings in which.

DETAILED DESCRIPTION

The preferential embodiments will be first described with reference to the geometry of creation of the drainage grooves on the surface of the porcelain stoneware tile.

Figure 1:
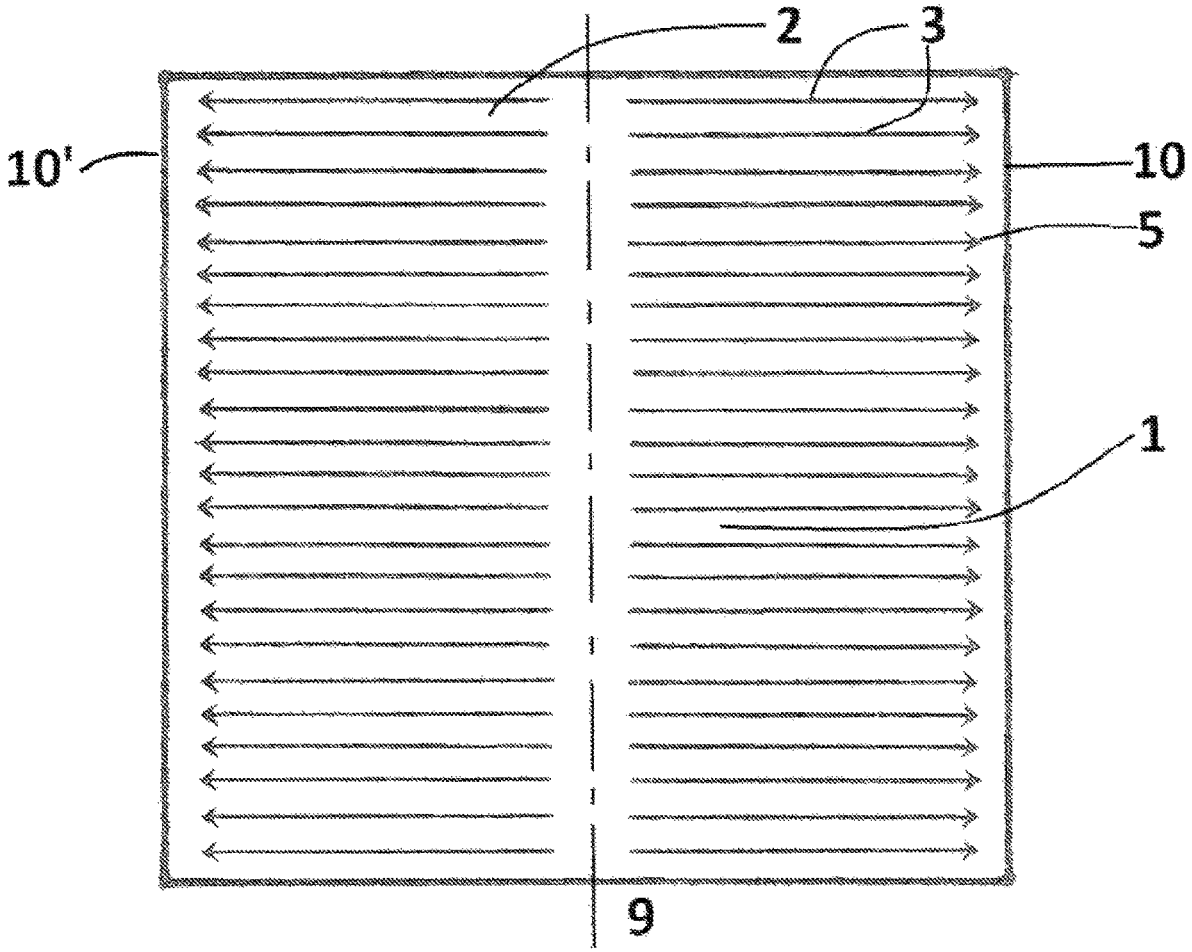
FIG. 1—Draining porcelain stoneware tile according to a first embodiment of the invention in which the drainage direction runs from the central axis of said planar surface towards the opposite edges of said tile with grooves which develop by parallel lines perpendicular to the respective edges.

FIG. 1 shows a draining porcelain stoneware tile (1) according to the invention. The draining porcelain stoneware tile (1) comprises a tile (1) having rectangular quadrilateral shape and edges with thickness (S), with a planar outer surface (2) of said tile, and a series of grooves (3) with variable geometry according to a drainage direction (5) provided on said outer surface (2). In the embodiment of FIG. 1, the drainage direction (5) runs from the central axis (4) of said planar surface towards the opposite edges (10, 10') of said tile with grooves (3) that develop by parallel lines perpendicular to the respective edges (10, 10') and to the central axis (4).

Figure 2:
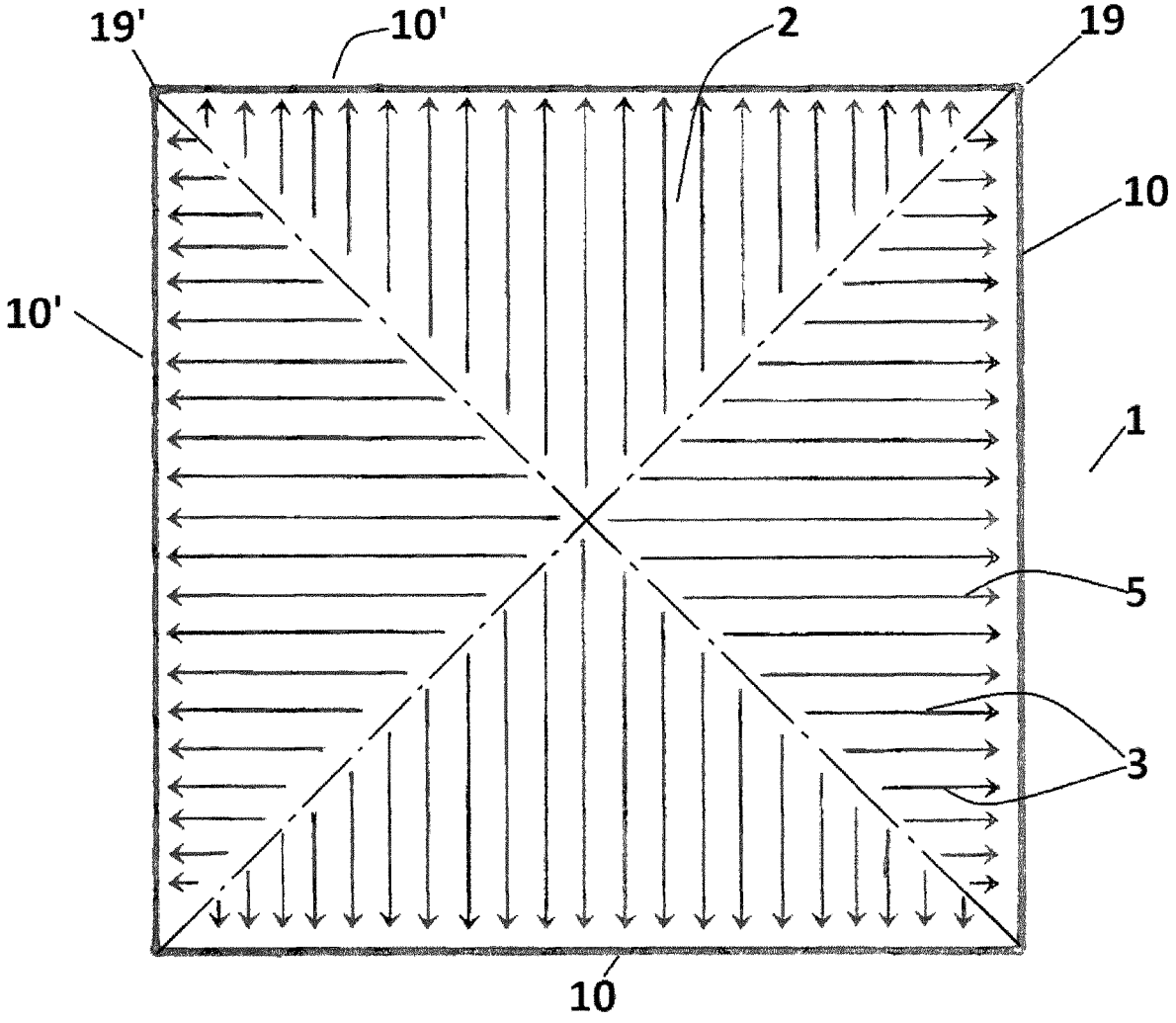
FIG. 2—Draining porcelain stoneware tile according to a second embodiment of the invention in which the drainage direction runs from the diagonal axes of said planar surface towards the opposite edges of said tile, in which the grooves develop by parallel lines perpendicular to the respective edges.

FIG. 2 shows a further embodiment of the grooves (3) for producing a draining porcelain stoneware tile (1) according to the invention in which the drainage direction (5, 5') runs from the diagonal axes of said planar surface (2) towards the opposite edges of said tile (10, 10'), in which the grooves develop by parallel lines perpendicular to the respective edges (10, 10'). According to this pattern, drainage of the water towards the edges of the tile is significantly improved since the mean distance to the edge of the tile is shorter, with the dimensions thereof remaining equal.

Figure 3:
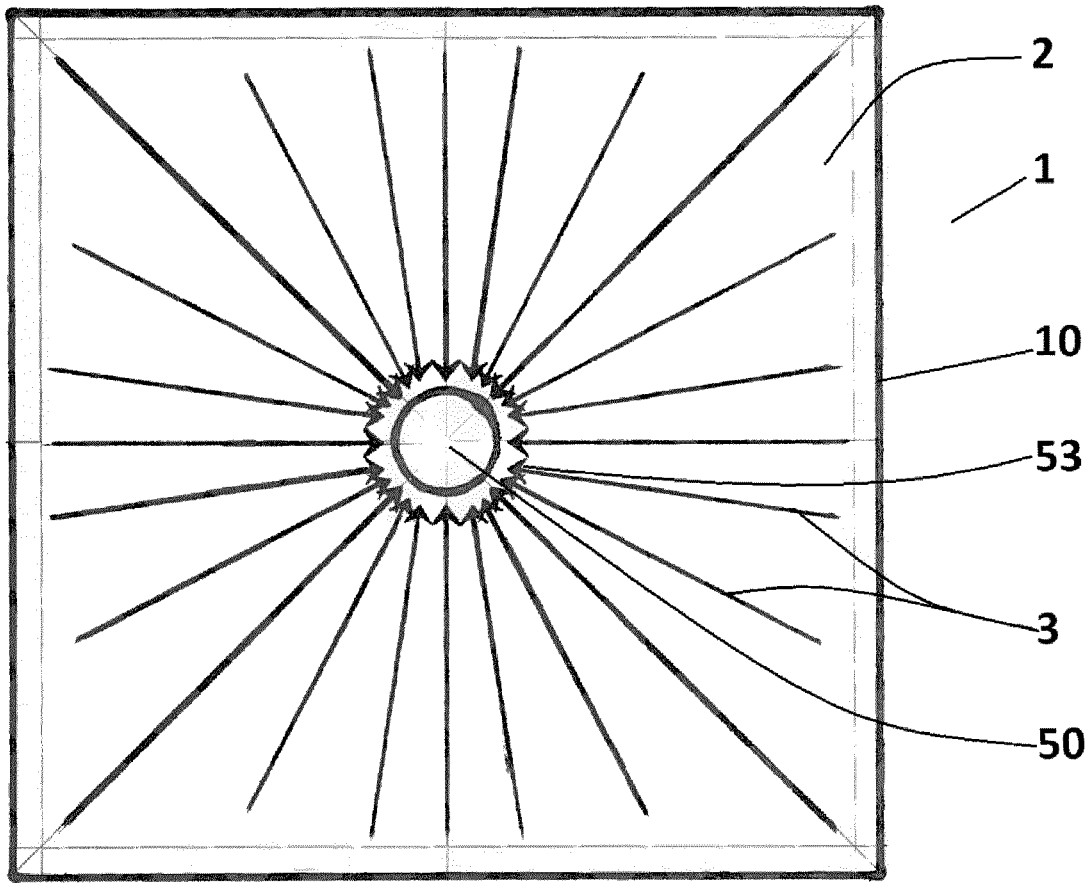
FIG. 3—Draining porcelain stoneware tile according to a third embodiment of the invention in which the tile has a drain fulcrum located on the planar surface and the drainage direction develops radially from the edges of said tile towards said drain fulcrum.

FIG. 3 shows a further embodiment of the grooves (53) for producing a draining porcelain stoneware tile (1) according to the invention in which the tile has a drain fulcrum (50) located on the planar surface and the drainage direction develops radially from the edges of said tile towards said drain fulcrum. The drainage towards a drain point which is central or in an asymmetrical position allows the technology according to the invention to be applied to shower trays, in which it is important to rapidly discharge the water that accumulates in the shower tray during use.

Figure 4:
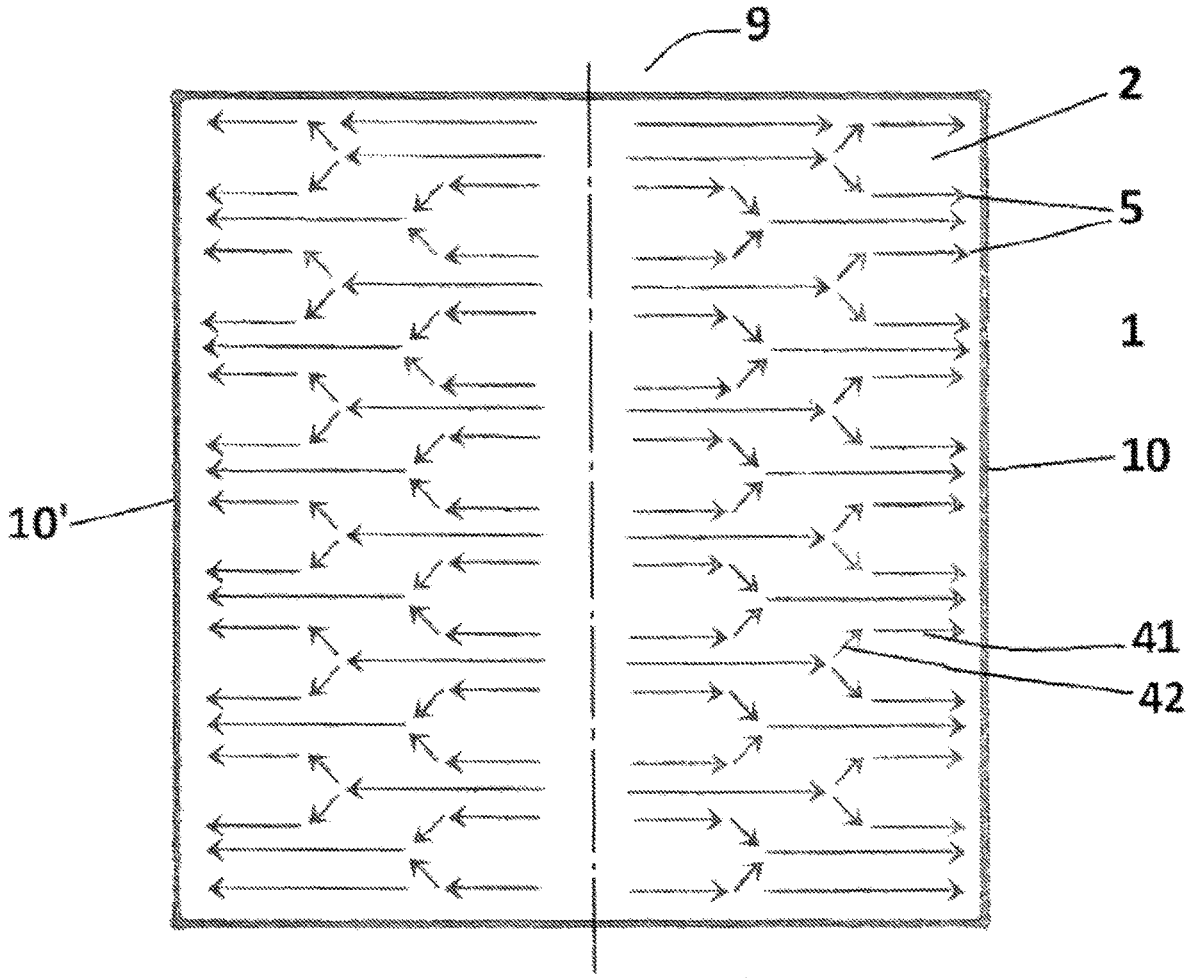
FIG. 4—Draining porcelain stoneware tile according to the invention in which the drainage direction runs from the central axis of said planar surface towards the opposite edges of said tile with grooves that develop by a combination of parallel and diagonal lines communicating with one another.

FIG. 4 shows a further embodiment of the grooves (41, 42) for producing a draining porcelain stoneware tile (1) according to the invention in which the drainage direction runs from the central axis of said planar surface towards the opposite edges of said tile with grooves which develop by combination of parallel lines (41) and diagonal lines (42) communicating with one another. The combination of parallel and diagonal lines improves the drainage with respect to the geometry of FIG. 1. The water is intercepted more easily by the oblique lines and conveyed towards the edge by the grooves perpendicular to the edge of the tile.

Figure 5:
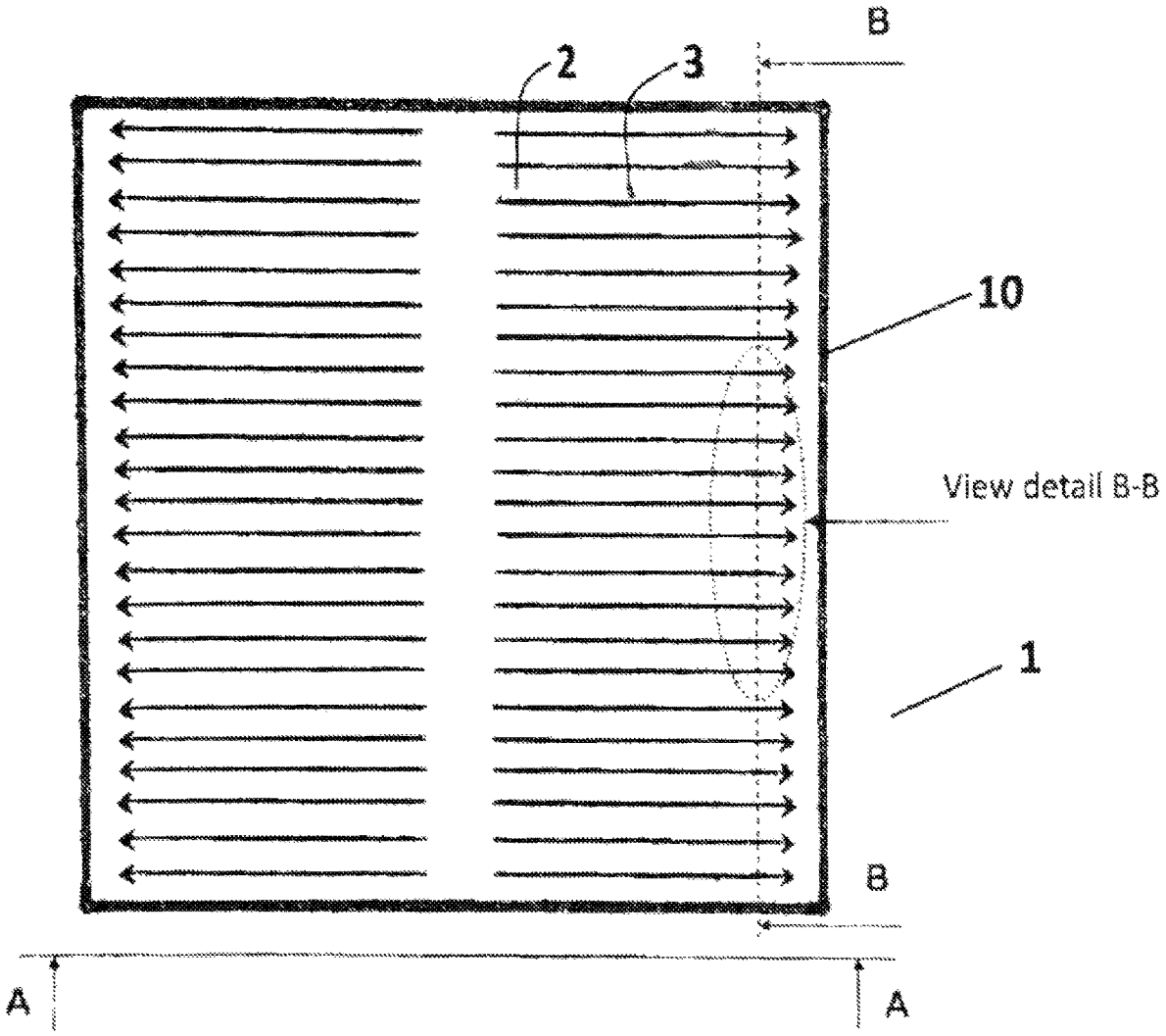
FIG. 5—Draining porcelain stoneware tile according to the invention in which the axis A-A and the axis B-B of the views of subsequent figures are indicated for the embodiment of FIG. 1.
Figure 6:
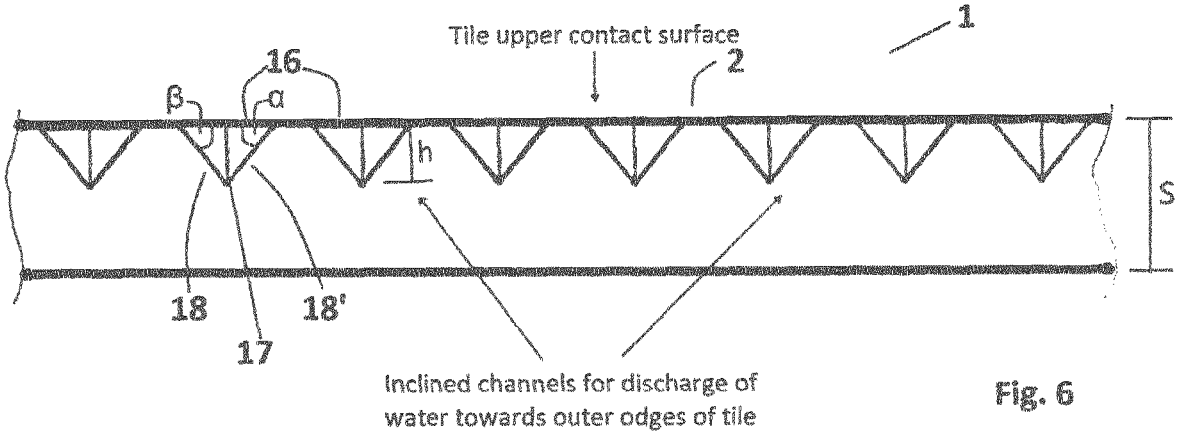
FIG. 6—Detail view according to axis B-B of the inclined grooves with triangular geometry.
Figure 7:
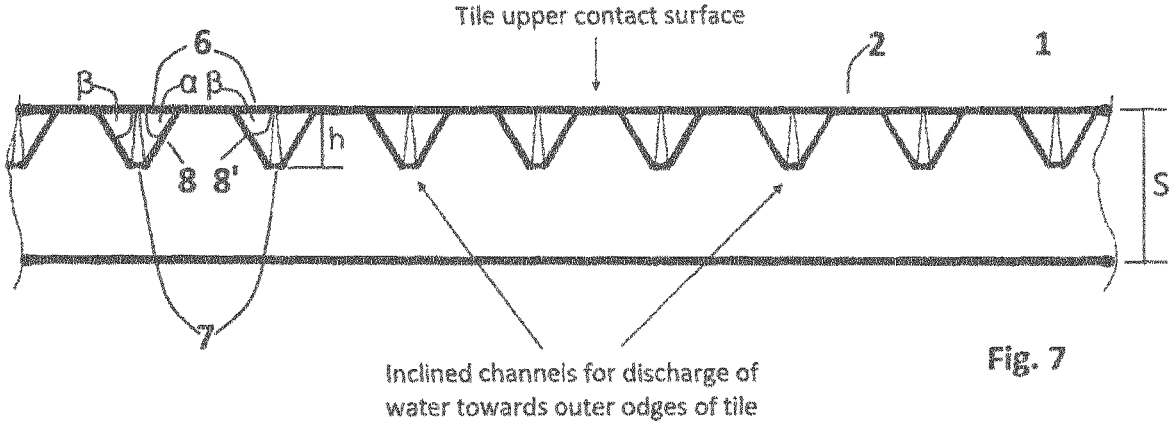
FIG. 7—Detail view according to axis B-B of the inclined grooves with trapezoidal geometry.
Figure 8:
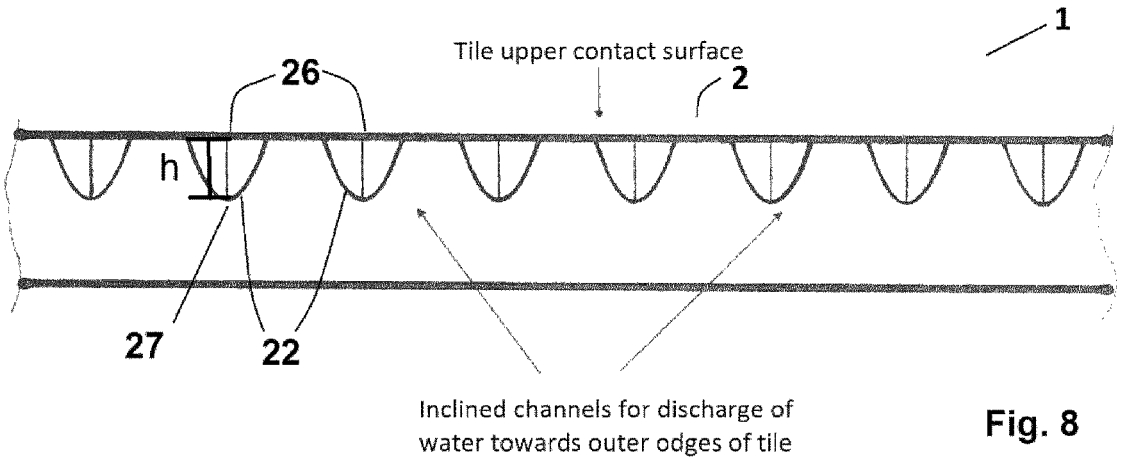
FIG. 8—Detail view according to axis B-B of the inclined grooves with elliptical geometry.

FIGS. 6, 7 and 8 refer to the lateral view detail along the plane B-B of a tile according to the invention shown in FIG. 5.

FIG. 6 shows the view detail according to axis B-B of the inclined grooves with triangular geometry. The porcelain stoneware tile with thickness S has a series of grooves with triangular section geometry which develop in the drainage direction. The triangular section has a base (16) and a vertex (17), the base is located on the planar surface (2) of the tile, the vertex (17) forms the bottom of said groove, oblique sides (18, 18') connecting base and vertex which form angles ($\alpha$) and ($\beta$) with respect to the base (16) and a height h between base and vertex of the triangle. The height of the triangular section of the groove h increases according to said drainage direction generating a groove with vertex that forms an inclined drainage plane of said groove. The triangular section grooves of this embodiment of the invention are preferably isosceles. The discharge of liquids depends heavily on the opening angle of the triangular section. Preferably for isosceles angle sections, this angle ranges from 70° to 15°.

Analogously, FIG. 7 shows a view detail according to axis B-B of the inclined grooves with trapezoidal geometry. The trapezoidal section has a major base (6) located on the planar surface (2), a minor base (7) which forms the bottom of said groove, oblique sides (8, 8') connecting said major and minor bases with angles (a) and (P) relative to said major base (6) and a height h between the major and minor bases. The height h of the trapezoidal section increases according to said drainage direction generating an inclined drainage plane in said groove. The trapezoidal section can be isosceles and the ratio between the dimensions of said minor and major bases ranges from 1:3 to 1:6; preferably said isosceles angle ranges from 70° to 15°, and said ratio between the dimensions of said minor and major bases ranges from 1:4 to 1:5.

FIG. 8 shows the view detail according to axis B-B of the inclined grooves with semi-elliptical geometry. By geometry of the groove with semi-elliptical section (22) we mean a section limited to a semi-axis (26), preferably the minor semi-axis. The semi-elliptical section has its semi-axis (26) located on the planar surface (2), an opposite vertex (27) that forms the bottom of the groove, and a height h between the semi-axis (26) and the vertex forming the bottom of the groove; the height h increases according to the drainage direction generating an inclined drainage plane in said groove.

Figure 9:
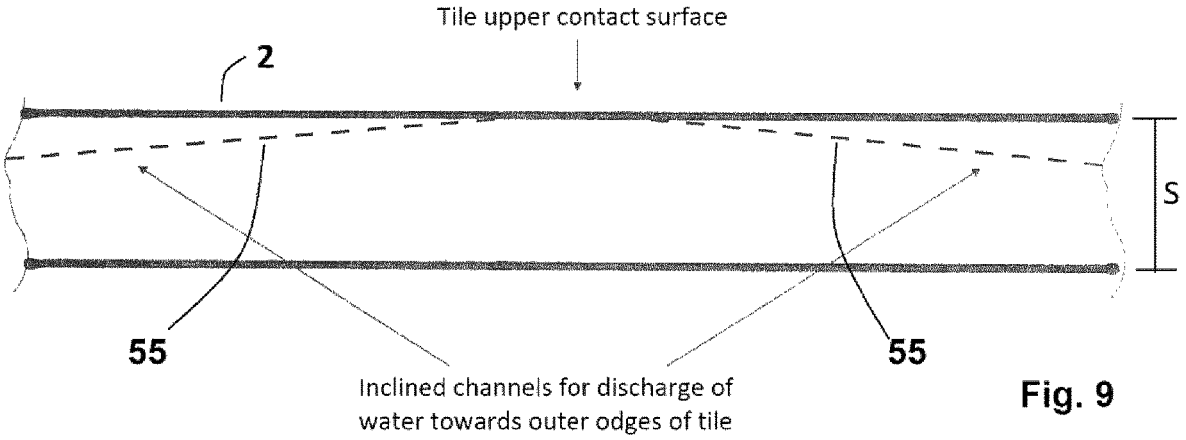
FIG. 9—Detail view according to axis A-A of the inclined grooves according to the invention.

FIG. 9 shows a view detail according to the axis A-A of the inclined grooves (55) according to the invention. In particular it shows evolution of the depth of the groove in the scheduled discharge direction.

In the case of both the triangular, trapezoidal and elliptical section, their respective development according to the drainage direction generates a groove with vertex with an inclination according to said drainage direction having a gradient ranging from 0.3% to 5.0%; preferably from 0.5% to 3.0%; more preferably from 1.0% % to 3.0%. Considering that the linear dimensions of a porcelain stoneware tile can reach 1000 mm, with gradient limit of 0.3%, grooves with maximum depth of approximately 1.5 mm can be achieved. The maximum gradient must be chosen according to the quadrilateral dimensions of the tile and the thickness of the latter.

The geometry of the channels moulded and/or incised on the porcelain stoneware for discharge of the water can vary according to aesthetic-functional requirements, while observing specific inclination values ranging from 0.3% (3 mm difference in level every 1000 mm longitude) up to a maximum of 5% (50 mm difference in level every 1000 mm longitude). Values below 0.3% do not guarantee good discharge of the water whereas values above 5% can not only be difficult to produce when the porcelain stoneware is fine in terms of thickness in relation to the format (dimension), but can also reduce the mechanical strength of the porcelain stoneware.

The invention also concerns the process of manufacturing draining porcelain stoneware tiles with a series of variable geometry grooves made on the outer surface according to a drainage direction. The method comprises a moulding phase during the phase of pressing the ceramic powders which form said ceramic piece with the use of punch/pad preformed with pattern according to the required geometry of the water drainage grooves.

According to a further embodiment the method comprises formation of the incision grooves in the green tile in which the pressed ceramic powder slab, dried or not, and not yet fired, is subjected to mechanical incision of the planar outer surface of said slab by means of diamond wheels, to create incisions according to the required geometry.

The method can comprise formation of the grooves by incision of the fired tile in which the slab is subjected to mechanical incision of the planar outer surface thereof with diamond wheels, to create incisions according to the required geometry.

From the above, the functional characteristics and advantages that can be obtained with draining porcelain stoneware tiles featuring a series of variable geometry grooves according to a drainage direction provided on the planar outer surface of a tile having rectangular quadrilateral shape and edges (10) with thickness (S) are evident. The discharge of liquids, mainly water, through grooves with widths, geometries and arrangements as claimed is considerably improved.

Different variations can be made to the subject of the present invention without departing from the ambit of what is described and claimed below with reference to the accompanying drawings and therefore from the protective scope of the present industrial property right.

The invention claimed is:

1. A draining porcelain stoneware unit, comprising:
a tile having a rectangular shape; and
a substantially planar outer surface with a plurality of grooves formed therein, parallel to edges of the tile;
wherein:
each of the plurality of grooves has a triangular cross-section, a base of the triangular cross-section is placed at the substantially planar surface, and the vertex of the triangular cross-section forms a bottom of the groove;
a height h between the base and the vertex increases from a first end of the groove to a second end of the groove;
wherein: a central axis of the tile extends between a first pair of parallel edges of the tile and drainage directions are defined as extending from the central axis toward a second pair of parallel edges of the tile, perpendicular to the first pair of parallel edges;
each of the plurality of grooves extends from the first end to the second end in one of the drainage directions, parallel to the first pair of parallel edges; and
the plurality of grooves are a first plurality of grooves, and the tile further comprises a second plurality of grooves, each of the second plurality of grooves extending in a diagonal direction with respect to the drainage direction from a second end of one of the first plurality of grooves to a first end of another one of the first plurality of grooves.

2. A draining porcelain stoneware unit, comprising:
a tile having a rectangular shape; and
a substantially planar outer surface with a plurality of grooves formed therein, parallel to edges of the tile;
wherein:
each of the plurality of grooves has a triangular cross-section, a base of the triangular cross-section is placed at the substantially planar surface, and the vertex of the triangular cross-section forms a bottom of the groove;
a height h between the base and the vertex increases from a first end of the groove to a second end of the groove;
wherein:
a first diagonal axis extends diagonally across the tile between a first pair of corners of the tile, a second diagonal axis extends diagonally across the tile between a second pair of corners of the tile, such that the second diagonal axis is perpendicular to the first diagonal axis;
drainage directions are defined as extending from one of the first diagonal axis and the second diagonal axis toward an edge of tile; and each of the plurality of grooves extends from the first end to the second end thereof in one of the drainage directions.

3. A draining porcelain stoneware unit, comprising:

a tile having a rectangular shape; and a substantially planar outer surface with a plurality of grooves formed therein, parallel to edges of the tile;

wherein:

each of the plurality of grooves has a trapezoidal section, the trapezoidal section has a major base disposed at the substantially planar surface and a minor base, smaller than the major base forming a bottom of said groove;

a height h between the major base and the minor base increases from a first end of the groove to a second end of the groove;

a central axis of the tile extends between a first pair of parallel edges of the tile and drainage directions are defined as extending from the central axis toward a second pair of parallel edges of the tile, perpendicular to the first pair of parallel edges;

each of the plurality of grooves extends from the first end to the second end in one of the drainage directions, parallel to the first pair of parallel edges; and the plurality of grooves are a first plurality of grooves, and the tile further comprises a second plurality of grooves, each of the second plurality of grooves extending in a diagonal direction with respect to the drainage direction from a second end of one of the first plurality of grooves to a first end of another one of the first plurality of grooves.

4. A draining porcelain stoneware unit, comprising:

a tile having a rectangular shape; and a substantially planar outer surface with a plurality of grooves formed therein, parallel to edges of the tile;

wherein:

each of the plurality of grooves has a trapezoidal section, the trapezoidal section has a major base disposed at the substantially planar surface and a minor base, smaller than the major base forming a bottom of said groove;

a height h between the major base and the minor base increases from a first end of the groove to a second end of the groove;

a first diagonal axis extends diagonally across the tile between a first pair of corners of the tile, a second diagonal axis extends diagonally across the tile between a second pair of corners of the tile, such that the second diagonal axis is perpendicular to the first diagonal axis, drainage directions are defined as extending from one of the first diagonal axis and the second diagonal axis toward an edge of tile, and each of the plurality of grooves extends from the first end to the second end thereof in one of the drainage directions.

5. A draining porcelain stoneware unit, comprising:

a tile having a rectangular shape; and a substantially planar outer surface with a plurality of grooves formed therein, parallel to edges of the tile;

wherein:

each of the plurality of grooves has a semi-elliptical cross-section, a semi-axis of the semi-elliptical cross-section is disposed at said substantially planar surface, and an opposite vertex of the semi-elliptical cross-section forms a bottom of the groove;

a height h between said semi-axis and the bottom vertex increases from a first end of the groove to a second end of the groove;

a central axis of the tile extends between a first pair of parallel edges of the tile and drainage directions are defined as extending from the central axis toward a second pair of parallel edges of the tile, perpendicular to the first pair of parallel edges;

each of the plurality of grooves extends from the first end to the second end in one of the drainage directions, parallel to the first pair of parallel edges; and the plurality of grooves are a first plurality of grooves, and the tile further comprises a second plurality of grooves, each of the second plurality of grooves extending in a diagonal direction with respect to the drainage direction from a second end of one of the first plurality of grooves to a first end of another one of the first plurality of grooves.

6. A draining porcelain stoneware unit, comprising a tile having a rectangular shape and a substantially planar outer surface with a plurality of grooves formed therein, parallel to edges of the tile;

wherein:

each of the plurality of grooves has a semi-elliptical cross-section;

a semi-axis of the semi-elliptical cross-section is disposed at said substantially planar surface, and an opposite vertex of the semi-elliptical cross-section forms a bottom of the groove;

a height h between said semi-axis and the bottom vertex increases from a first end of the groove to a second end of the groove;

a first diagonal axis extends diagonally across the tile between a first pair of corners of the tile;

a second diagonal axis extends diagonally across the tile between a second pair of corners of the tile, such that the second diagonal axis is perpendicular to the first diagonal axis;

drainage directions are defined as extending from one of the first diagonal axis and the second diagonal axis toward an edge of tile; and each of the plurality of grooves extends from the first end to the second end thereof in one of the drainage directions.

7. The unit according to claim 3, wherein the bottom of each of the plurality of grooves has an inclination gradient of between 0.3% and 5.0% from the first end to the second end thereof.

8. The unit according to claim 7, wherein the trapezoidal cross-section is isosceles between the minor base and the major base and a ratio between a length of the minor base and a length of the major base between 1:3 and 1:6; and an isosceles angle of the trapezoidal cross-section is between 70° and 15°.

9. The unit according to claim 1, wherein the triangular cross-section is isosceles, an isosceles angle of the triangular cross-section is between 700 and 15° and the bottom of each of the plurality of grooves an inclination gradient of between 0.3% and 5.0% from the first end to the second end thereof.

10. The unit according to claim 5, wherein the bottom of each of the plurality of grooves has an inclination gradient between 0.3% and 5.0% from the first end to the second end thereof.

11. The unit according to claim 4, wherein the bottom of each of the plurality of grooves has an inclination gradient of between 0.3% and 5.0% from the first end to the second end thereof.

12. The unit according to claim 4, wherein the trapezoidal cross-section is isosceles between the minor base and the major base and a ratio between a length of the minor base and a length of the major base between 1:3 and 1:6; and an isosceles angle of the trapezoidal cross-section is between 70° and 15°.

13. The unit according to claim 2, wherein the triangular cross-section is isosceles, an isosceles angle of the triangular cross-section is between 70° and 15° and the bottom of each of the plurality of grooves an inclination gradient of between 0.3% and 5.0% from the first end to the second end thereof.

14. The unit according to claim 6, wherein the bottom of each of the plurality of grooves has an inclination gradient between 0.3% and 5.0% from the first end to the second end thereof.

* * * * *